US005806025A

United States Patent [19]

Vis et al.

[11] Patent Number: 5,806,025

[45] Date of Patent: Sep. 8, 1998

[54] METHOD AND SYSTEM FOR ADAPTIVE FILTERING OF SPEECH SIGNALS USING SIGNAL-TO-NOISE RATIO TO CHOOSE SUBBAND FILTER BANK

[75] Inventors: Marvin L. Vis, Longmont, Colo.; Aruna Bayya, Irvine, Calif.

[73] Assignee: U S West, Inc., Englewood, Colo.

[21] Appl. No.: 695,097

[22] Filed: Aug. 7, 1996

[51] Int. Cl.[6] ..... G10L 3/02

[52] U.S. Cl. ..... 704/226; 704/210; 381/94.3

[58] Field of Search ..... 704/226, 227, 704/228, 203–205, 268, 269, 210, 248, 233, 224, 225, 206, 500, 501; 381/94.3

[56] References Cited

U.S. PATENT DOCUMENTS

| | | | |
|---|---|---|---|
| 3,803,357 | 4/1974 | Sacks | 381/94.3 |
| 4,052,559 | 10/1977 | Paul et al. | 333/166 |
| 4,737,976 | 4/1988 | Borth et al. | 455/563 |
| 4,811,404 | 3/1989 | Vilmur et al. | 381/94.3 |
| 4,937,873 | 6/1990 | McAulay et al. | 704/265 |
| 4,942,607 | 7/1990 | Schöder et al. | 704/203 |
| 5,008,939 | 4/1991 | Bose et al. | 381/15 |
| 5,097,510 | 3/1992 | Graupe | 704/233 |
| 5,214,708 | 5/1993 | McEachern | 704/266 |
| 5,253,298 | 10/1993 | Parker et al. | 381/13 |
| 5,355,431 | 10/1994 | Kane et al. | 704/226 |
| 5,406,635 | 4/1995 | Jarvinen | 381/68.4 |
| 5,432,859 | 7/1995 | Yang et al. | 704/203 |
| 5,450,522 | 9/1995 | Hermansky et al. | 704/211 |
| 5,485,524 | 1/1996 | Kuusama et al. | 381/94.3 |
| 5,524,148 | 6/1996 | Allen et al. | 379/391 |

OTHER PUBLICATIONS

John B. Allen, "Short Term Spectral Analysis Synthesis, and Modification by Discrete Fourier Transf.", IEEE Tr. on Acc., Spe. & Signal Proc., vol. ASSP–25, No. 3, Jun. 1977.

"Signal Estimation from Modified Short–Time Fourier Transform," IEEE Trans. on Accou. Speech and Signal Processing, vol. ASSP–32, No. 2, Apr. 1984, D.W. Griffin and AJ.S. Lim.

Simon Haykin, "Neural NetWorks—A Comprhensive Foundation," 1994.

K. Sam Shanmugan, "Random Signals: Detection, Estimation and Data Analysis," 1988.

H. Kwakernaak, R. Sivan, and R. Strijbos, "Modern Signals and Systems," pp. 314 and 531, 1991.

M. Sambur, "Adaptive Noise Canceling for Speech Signals," *IEEE Trans. ASSP*, vol. 26, No. 5, pp. 419–423, Oct., 1978.

(List continued on next page.)

*Primary Examiner*—David R. Hudspeth
*Assistant Examiner*—Donald L. Storm
*Attorney, Agent, or Firm*—Brooks & Kushman P.C.

[57] ABSTRACT

A method and system for adaptively filtering a speech signal. The method includes decomposing the signal into subbands, which may include performing a discrete Fourier transform on the signal to provide approximately orthogonal components. The method also includes determining a speech quality indicator for each subband, which may include estimating a signal-to-noise ratio for each subband. The method also includes selecting a filter for filtering each subband depending on the speech quality indicator, which may include estimating parameters for the filter based on a clean speech signal. The method further includes determining an overall average error for the filtered subbands, which may include calculating a mean-squared error. The method still further includes identifying at least one filtered subband which, if excluded from the filtered speech signal, would reduce the overall average error determined, and combining, with exception of the filtered subbands identified, the filtered subbands to provide an estimated filtered speech signal. The system includes filters and software for performing the method.

16 Claims, 3 Drawing Sheets

OTHER PUBLICATIONS

U. Ephraim and H.L. Van Trees, "A Signal Subspace Approach for Speech Enhancement," *IEEE Proc. ICASSP*, vol. II, pp. 355–358, 1993.

Y. Ephraim and H.L. Van Trees, "A Spectrally–Based Signal Subspace Approach for Speech Enhancement," *IEEE ICASSP Proceedings*, pp. 804–807, 1995.

S. F. Boll, "Suppression of Acoustic Noise in Speech Using Spectral Subtraction," *Proc. IEEE ASSP*vol. 27, No. 2, pp. 113–120, Apr. 1979.

G.S. Kang and L.J. Fransen, "Quality Improvement of LPC–Processed Noisy Speech By Using Spectral Subtraction," *IEEE Trans. ASSP* 37:6, pp. 939–942, Jun. 1989.

M. Viberg and B. Ottersten, "Sensor Array Processing Based on Subspace Fitting," *IEEE Trans. ASSP*, 39:5, pp. 1110–1121, May, 1991.

L. L. Scharf, "The SVD and Reduced–Rank Signal Processing," *Signal Processing* 25, pp. 113–133, Nov. 1991.

H. Hermansky and N. Morgan, "RASTA Processing of Speech," *IEEE Trans. Speech and Audio Proc.*, 2:4, pp. 578–589, Oct., 1994.

H. Hermansky, E.A. Wan and C. Avendano, "Speech Enhancement Based on Temporal Processing," IEEE ICASSP Conference Proceedings, pp. 405–408, Detroit, MI, 1995.

D. L. Wang and J. S. Lim, "The Unimportance of Phase in Speech Enhancement," *IEEE Trans. ASSP*, vol. ASSP–30, No. 4, pp. 679–681, Aug. 1982.

H. G. Hirsch, "Estimation of Noise Spectrum and its Application to SNR–Estimation and Speech Enhancement,", *Technical Report*, pp. 1–32, Intern'l Computer Science Institute.

A. Kundu, "Motion Estimation by Image Content Matching and Application to Video Processing," to be published *ICASSP, 1996*, Atlanta, GA.

Harris Drucker, "Speech Processing in a High Ambient Noise Environment," *IEEE Trans. Audio and Electroacoustics*, vol. 16, No. 2, pp. 165–168, Jun. 1968.

METHOD AND SYSTEM FOR ADAPTIVE FILTERING OF SPEECH SIGNALS USING SIGNAL-TO-NOISE RATIO TO CHOOSE SUBBAND FILTER BANK

RELATED APPLICATION

This application is related to U.S. patent application Ser. No. 08/694,654, which was filed on the same date and assigned to the same assignee as the present application; Ser. No. 08/496,068, which was filed on Jun. 28, 1995; and 08/722,547, which was filed on Sep. 27, 1996.

TECHNICAL FIELD

This invention relates to an adaptive method and system for filtering speech signals.

BACKGROUND ART

In wireless communications, background noise and static can be annoying in speaker to speaker conversation and a hindrance in speaker to machine recognition. As a result, noise suppression is an important part of the enhancement of speech signals recorded over wireless channels in mobile environments.

In that regard, a variety of noise suppression techniques have been developed. Such techniques typically operate on single microphone, output-based speech samples which originate in a variety of noisy environments, where it is assumed that the noise component of the signal is additive with unknown coloration and variance.

One such technique is Least Mean-Squared (LMS) Predictive Noise Cancelling. In this technique it is assumed that the additive noise is not predictable, whereas the speech component is predictable. LMS weights are adapted to the time series of the signal to produce a time-varying matched filter for the predictable speech component such that the mean-squared error (MSE) is minimized. The estimated clean speech signal is then the filtered version of the time series.

However, the structure of speech in the time domain is neither coherent nor stationary enough for this technique to be effective. A trade-off is therefore required between fast settling time/good tracking ability and the ability to track everything (including noise). This technique also has difficulty with relatively unstructured non-voiced segments of speech.

Another noise suppression technique is Signal Subspace (SSP) filtering (which here includes Spectral Subtraction (SS)). SSP is essentially a weighted subspace fitting applied to speech signals, or a set of bandpass filters whose outputs are linearly weighted and combined. SS involves estimating the (additive) noise magnitude spectrum, typically done during non-speech segments of data, and subtracting this spectrum from the noisy speech magnitude spectrum to obtain an estimate of the clean speech spectrum. If the resulting spectral estimate is negative, it is rectified to a small positive value. This estimated magnitude spectrum is then combined with the phase information from the noisy signal and used to construct an estimate of the clean speech signal.

SSP assumes the speech signal is well-approximated by a sum of sinusoids. However, speech signals are rarely simply sums of undamped sinusoids and can, in many common cases, exhibit stochastic qualities (e.g., unvoiced fricatives). SSP relies on the concept of bias-variance trade-off For channels having a Signal-to-Noise Ratio (SNR) less than 0 dB, some bias is permitted to give up a larger dosage of variance and obtain a lower overall MSE. In the speech case, the channel bias is the clean speech component, and the channel variance is the noise component. However, SSP does not deal well with channels having SNR greater than zero.

In addition, SS is undesirable unless the SNR of the associated channel is less than 0 dB (i.e., unless the noise component is larger than the signal component). For this reason, the ability of SS to improve speech quality is restricted to speech masked by narrowband noise. SS is best viewed as an adaptive notch filter which is not well applicable to wideband noise.

Still another noise suppression technique is Wiener filtering, which can take many forms including a statistics-based channel equalizer. In this context, the time domain signal is filtered in an attempt to compensate for non-uniform frequency response in the voice channel. Typically, this filter is designed using a set of noisy speech signals and the corresponding clean signals. Taps are adjusted to optimally predict the clean sequence from the noisy one according to some error measure. Once again, however, the structure of speech in the time domain is neither coherent nor stationary enough for this technique to be effective.

Yet another noise suppression technique is Relative Spectral (RASTA) speech processing. In this technique, multiple filters are designed or trained for filtering spectral subbands. First, the signal is decomposed into N spectral subbands (currently, Discrete Fourier Transform vectors are used to define the subband filters). The magnitude spectrum is then filtered with N/2+1 linear or non-linear neural-net subband filters.

However, the characteristics of the complex transformed signal (spectrum) have been elusive. As a result, RASTA subband filtering has been performed on the magnitude spectrum only, using the noisy phase for reconstruction. However, an accurate estimate of phase information gives little, if any, noticeable improvement in speech quality.

The dynamic nature of noise sources and the non-stationery nature of speech ideally call for adaptive techniques to improve the quality of speech. Most of the existing noise suppression techniques discussed above, however, are not adaptive. While some recently proposed techniques are designed to adapt to the noise level or SNR, none take into account the non-stationary nature of speech and try to adapt to different sound categories.

Thus, there exists a need for an adaptive noise suppression technique. Ideally, such a technique would employ subband filterbank chosen according to the SNR of a channel, independent of the SNR estimate of other channels. By specializing sets of filterbanks for various SNR levels, appropriate levels for noise variance reduction and signal distortion may be adaptively chosen to minimize overall MSE.

DISCLOSURE OF INVENTION

Accordingly, it is the principle object of the present invention to provide an improved method and system for filtering speech signals.

According to the present invention, then, a method and system are provided for adaptively filtering a speech signal. The method comprises decomposing the speech signal into a plurality of subbands, and determining a speech quality indicator for each subband. The method further comprises selecting one of a plurality of filters for each subband, wherein the filter selected depends on the speech quality indicator determined for the subband, filtering each subband according to the filter selected, and combining the filtered subbands to provide an estimated filtered speech signal.

The system of the present invention for adaptively filtering a speech signal comprises means for decomposing the speech signal into a plurality of subbands, means for determining a speech quality indicator for each subband, and a plurality of filters for filtering the subbands. The system further comprises means for selecting one of the plurality of filters for each subband, wherein the filter selected depends on the speech quality indicator determined for the subband, and means for combining the filtered subbands to provide an estimated filtered speech signal.

These and other objects, features and advantages will be readily apparent upon consideration of the following detailed description in conjunction with the accompanying drawings.

BEST MODE FOR CARRYING OUT THE INVENTION

Figure 1A:
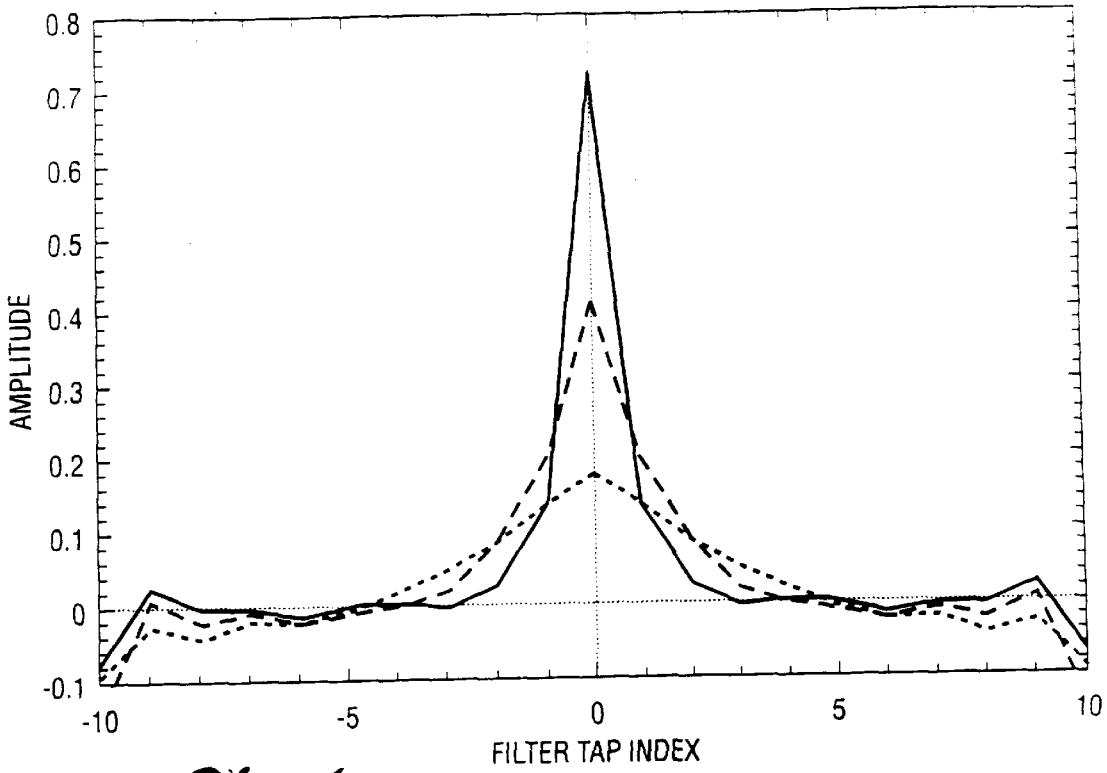
FIGS. 1*a–b* are plots of filterbanks trained at Signal-to-Noise Ratio values of 0, 10, 20 dB at subbands centered around 800 Hz and 2200 Hz, respectively.

Traditionally, the Wiener filtering techniques discussed above have been packaged as a channel equalizer or spectrum shaper for a sequence of random variables. However, the subband filters of the RASTA form of Wiener filtering can more properly be viewed as Minimum Mean-squared Error Estimators (MMSEE) which predict the clean speech spectrum for a given channel by filtering the noisy spectrum, where the filters are pre-determined by training them with respect to MSE on pairs of noisy and clean speech samples.

In that regard, original versions of RASTA subband filters consisted of heuristic Autoregressive Means Averaging (ARMA) filters which operated on the compressed magnitude spectrum. The parameters for these filters were designed to provide an approximate matched filter for the speech component of noisy compressed magnitude spectrums and were obtained using clean speech spectra examples as models of typical speech. Later versions used Finite Impulse Response (FIR) filterbanks which were trained by solving a simple least squares prediction problem, where the FIR filters predicted known clean speech spectra from noisy realizations of it.

Assuming that the training samples (clean and noisy) are representative of typical speech samples and that speech sequences are approximately stationary across the sample, it can be seen that a MMSEE is provided for speech magnitude spectra from noisy speech samples. In the case of FIR filterbanks, this is actually a Linear MMSEE of the compressed magnitude spectrum. This discussion can, however, be extended to include non-linear predictors as well. As a result, the term MMSEE will be used, even as reference is made to LMMSEE.

There are, however, two problems with the above assumptions. First, the training samples cannot be representative of all noise colorations and SNR levels. Second, speech is not a stationary process. Nevertheless, MMSEE may be improved by changing those assumptions and creating an adaptive subband Wiener filter which minimizes MSE using specialized filterbanks according to speaker characteristics, speech region and noise levels.

In that regard, the design of subband FIR filters is subject to a MSE criterion. That is, each subband filter is chosen such that it minimizes squared error in predicting the clean speech spectra from the noisy speech spectra. This squared error contains two components i) signal distortion (bias); and ii) noise variance. Hence a bias-variance trade-off is again seen for minimizing overall MSE. This trade-off produces filterbanks which are highly dependent on noise variance. For example, if the SNR of a "noisy" sample were infinite, the subband filters would all be simply $\delta_k$, where $$\delta_k = \begin{cases} 1, & k = 0 \\ 0, & o.w. \end{cases}.$$

On the other hand, when the SNR is low, filterbanks are obtained whose energy is smeared away from zero. This phenomenon occurs because the clean speech spectra is relatively coherent compared to the additive noise signals. Therefore, the overall squared error in the least squares (training) solution is minimized by averaging the noise component (i.e., reducing noise variance) and consequently allowing some signal distortion. If this were not true, nothing would be gained (with respect to MSE) by filtering the spectral magnitudes of noisy speech.

Figure 1B:
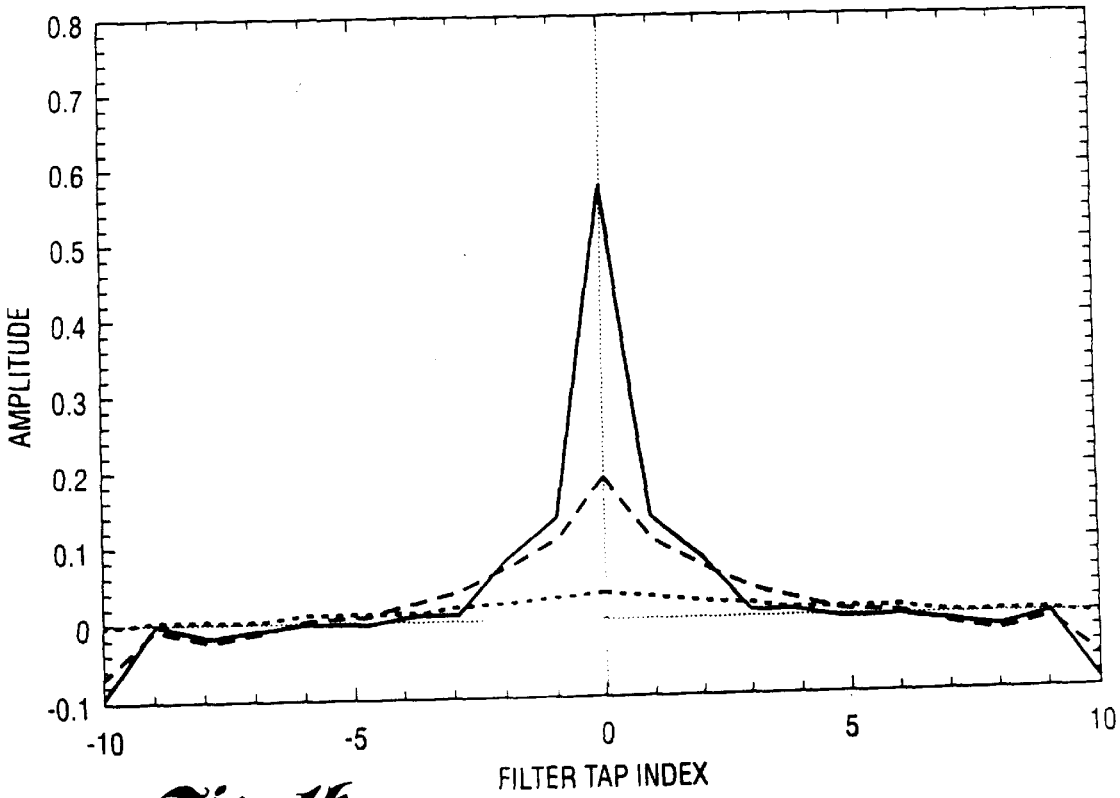
Figure 2A:
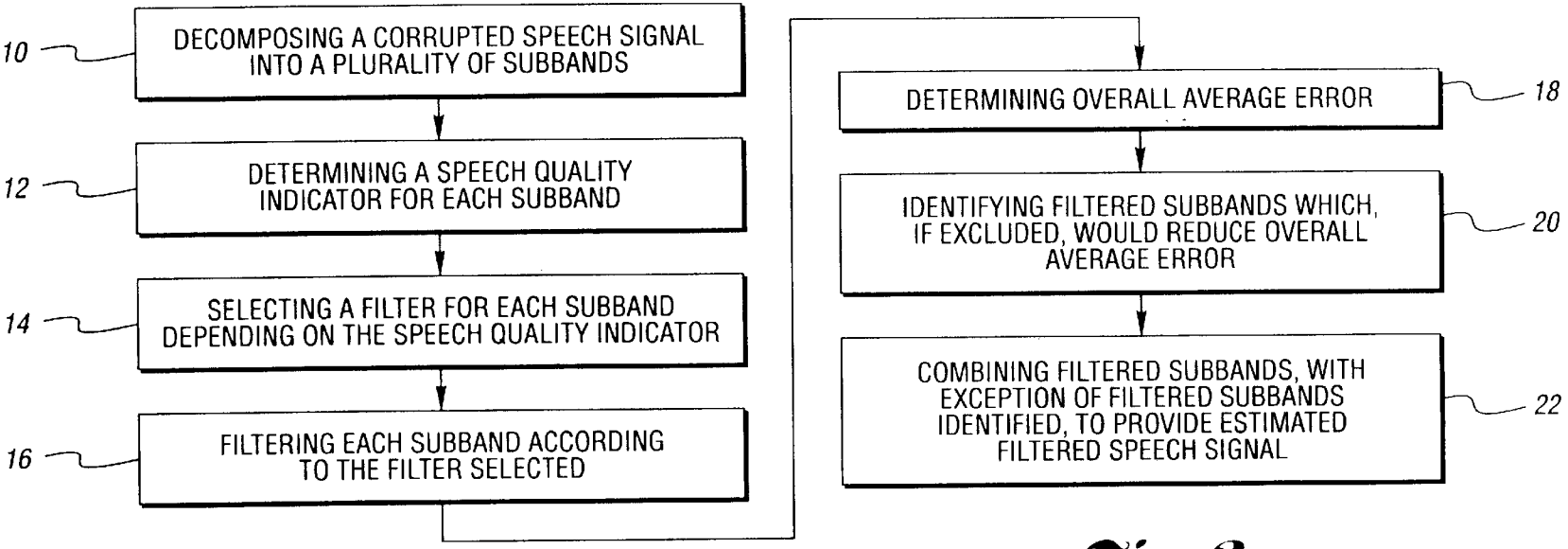
FIGS. 2*a–e* are flowcharts of the method of the present invention.

Three typical filterbanks which were trained at SNR values of 0, 10, 20 dB, respectively, are shown in FIG. 1 to illustrate this point. The first set of filters (FIG. 1*a*) correspond to the subband centered around 800 Hz, and the second (FIG. 1*b*) represent the region around 2200 Hz. The filters corresponding to lower SNR's (In FIG. 1, the filterbanks for the lower SNR levels have center taps which are similarly lower) have a strong averaging (lowpass) capability in addition to an overall reduction in gain.

With particular reference to the filterbanks used at 2200 Hz (FIG. 1*b*), this region of the spectrum is a low-point in the average spectrum of the clean training data, and hence the subband around 2200 Hz has a lower channel SNR than the overall SNR for the noisy versions of the training data. So, for example, when training with an overall SNR of 0 dB, the subband SNR for the band around 2200 Hz is less than 0 dB (i.e., there is more noise energy than signal energy). As a result, the associated filterbank, which was trained to minimize MSE, is nearly zero and effectively eliminates the channel.

Significantly, if the channel SNR cannot be brought above 0 dB by filtering the channel, overall MSE can be improved by simply zeroing the channel. This is equivalent to including a filter in the set having all zero coefficients. To predetermine the post-filtered SNR, three quantities are needed: i) an initial (pre-filtered) SNR estimate; ii) the expected noise reduction due to the associated subband filter; and iii) the expected (average speech signal distortion introduced by the filter. For example, if the channel SNR is estimated to be −3 dB, the associated subband filter's noise variance reduction capability at 5 dB, and the expected distortion at −1 dB, a positive post-filtering SNR is obtained and the filtering operation should be performed. Conversely, if the pre-filtering SNR was instead −5 dB, the channel should simply be zeroed.

The above discussion assumes that an estimator of subband SNR is available This estimator must be used for the latter approach of determining the usefulness of a channel's output as well as for adaptively determining which subband filter should be used. In that regard, an SNR estimation technique well known in the art which uses the bimodal characteristic of a noisy speech sample's histogram to determine the expected values of signal and noise energy may be used. However, accurately tracking multiple (subband) SNR estimates is difficult since instantaneous SNR for speech signals is a dramatically varying quantity. Hence, the noise spectrum, which is a relatively stable quantity, may instead be tracked. This estimate may then be used to predict the localized subband SNR values. The bimodal idea of the known SNR estimation technique described above may still contribute as a noise spectrum estimate.

Thus, according to the present invention, speech distortion is allowed in exchange for reduced noise variance. This is achieved by throwing out channels whose output SNR would be less than 0 dB and by subband filtering the noisy magnitude spectrum. Noise averaging gives a significant reduction in noise variance, while effecting a lesser amount of speech distortion (relative to the reduction in noise variance). Subband filterbanks are chosen according to the SNR of a channel, independent of the SNR estimate of other channels, in order to adapt to a variety of noise colorations and variations in speech spectra. By specializing sets of filterbanks for various SNR levels, appropriate levels for noise variance reduction and signal distortion may be adaptively chosen according to subband SNR estimates to minimize overall MSE. In such a fashion, the problem concerning training samples which cannot be representative of all noise colorations and SNR levels is solved.

Referring now to FIGS. 2*a–e*, flowcharts of the method of the present invention are shown. As seen therein, the method comprises decomposing (10) the speech signal into a plurality of subbands, determining (12) a speech quality indicator for each subband, selecting (14) one of a plurality of filters for each subband, wherein the filter selected depends on the speech quality indicator determined for the subband, and filtering (16) each subband according to the filter selected. At this point, the filtered subbands may simply be combined (not shown) to provide an estimated filtered speech signal.

However, the method may further comprise determining (18) an overall average error for a filtered speech signal comprising the filtered subbands, and identifying (20) at least one filtered subband which, if excluded from the filtered speech signal, would reduce the overall average error determined. In this embodiment, the method still further comprises combining (22), with the exception of the at least one filtered subband identified, the filtered subbands to provide an estimated filtered speech signal.

While the subband decomposition described above is preferably accomplished by Discrete Fourier Transform (DFT), it should be noted that any arbitrary transform which well-decomposes speech signals into approximately orthogonal components may also be employed (11) (e.g., Karhunen-Loeve Transform (KLT)), Likewise, speech quality estimation is preferably accomplished using the SNR estimation technique previously described where the subband SNR for each subband in the decomposition is estimated (13). However, other speech quality estimation techniques may also be used.

It should also be noted that, with respect to subband filter determination, the estimates of speech quality are used to assign a filter to each channel, where the filters are chosen from a set of pre-trained filters (15). This set of pre-trained filters represents a range of speech quality (e.g., SNR), where each is trained for a specific level of quality, with each subband channel having its own set of such filters to choose from. It can thus be seen that multiple filters are trained for each subband, and the appropriate subband filter is adaptively chosen according to the quality indicator. It should be noted that these filters are not necessarily linear and can exist as "neural networks" which are similarly trained and chosen.

Still further, with respect to bias-variance trade-off, if the quality indicator shows that overall average error could be reduced by throwing out a subband channel from the clean speech estimate, then that channel is discarded. This trade-off is performed after choosing subband filters because the thresholds for the trade-off are a function of the chosen filterbank. Remaining outputs of the subband filters are used to reconstruct a clean estimate of the speech signal. While error is preferably measured according to the mean-squared technique (19), other error measures may also be used.

Thus, using quality indicators (e.g., SNR), subband filters for subband speech processing are adaptively chosen. If the quality indicator is below a threshold for a subband channel, the channel's contribution to the reconstruction is thrown out in a bias-variance trade-off for reducing overall MSE.

Figure 3:
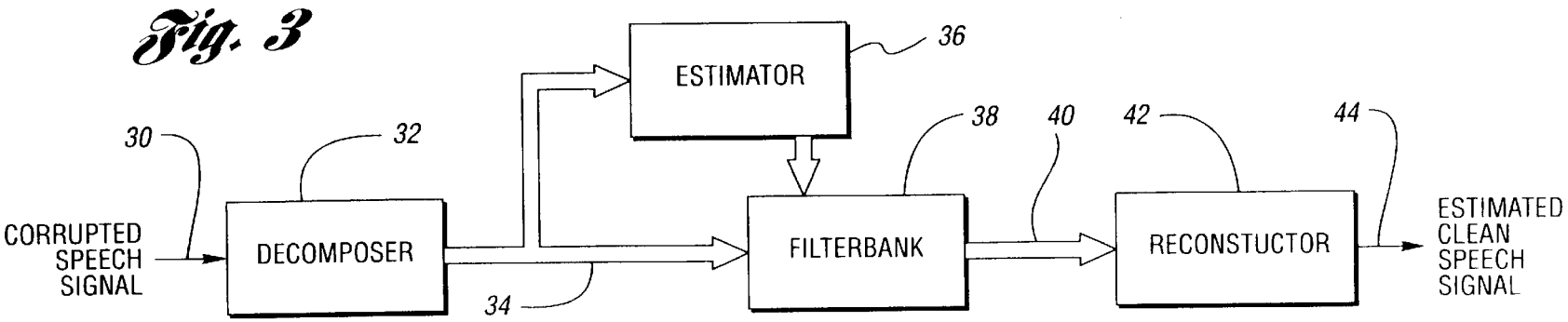
FIG. 3 is a block diagram of the system of the present invention.
Figure 2B:
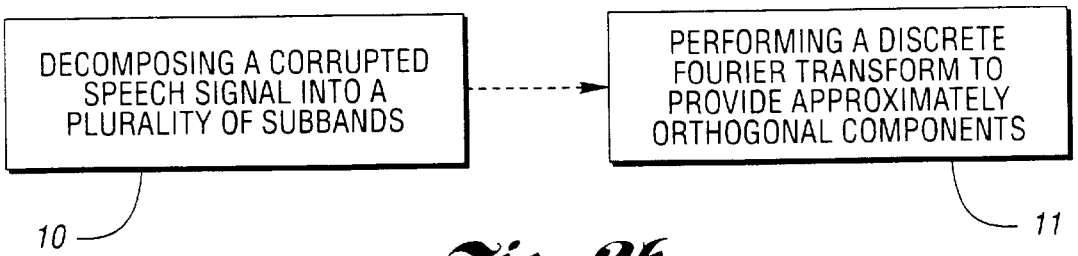
Figure 2C:
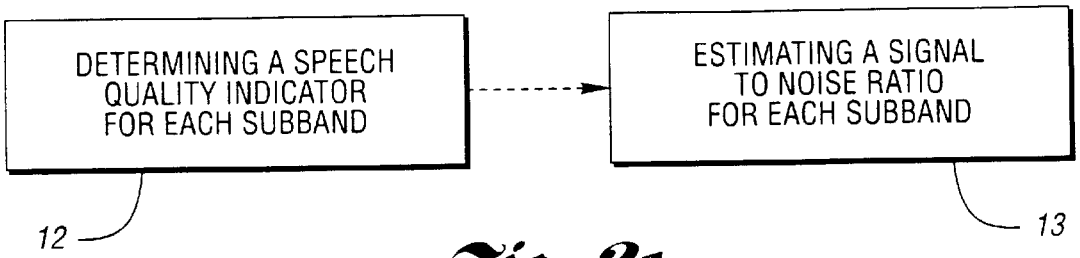
Figure 2D:
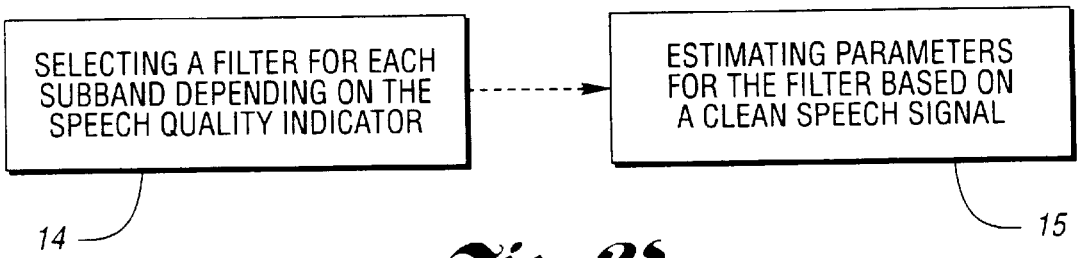
Figure 2E:
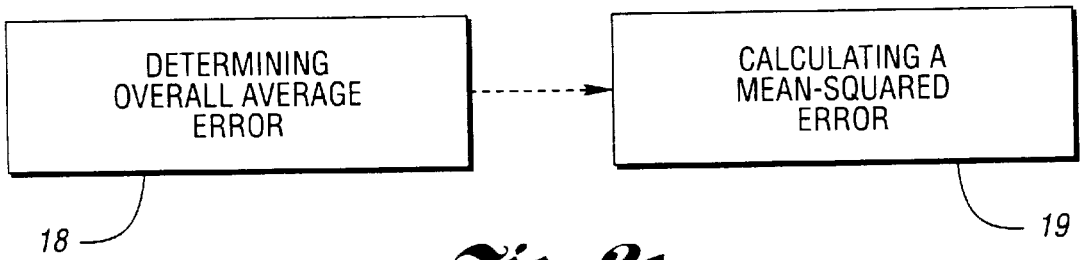

Referring next to FIG. 3, a block diagram of the system of the present invention is shown. As seen therein, a corrupted speech signal (30) is transmitted to a decomposer (32). As previously discussed with respect to the method of the present invention, decomposer (32) decomposes speech signal (30) into a plurality of subbands. As also previously discussed, such decomposing is preferably accomplished by a performing a discrete Fourier transform on speech signal (30). However, other transform functions which well-decompose speech signal (30) into approximately orthogonal components may also be used, such as a KLT.

Decomposer (32) generates a decomposed speech signal (34), which is transmitted to an estimator (36) and a filter bank (38). Once again, as previously discussed with respect to the method of the present invention, estimator (36) determines a speech quality indicator for each subband. Preferably, such a speech quality indicator is an estimated SNR.

Depending on the speech quality of the subband, estimator (36) also selects one of a plurality of filters from filter bank (38) for that subband, wherein each of the plurality of filters is associated with one of the plurality of subbands. As previously discussed, the plurality of filters from filter bank (38) may be pre-trained using clean speech signals (15). Moreover, while any type of estimator (36) well known in the art may be used, estimator (36) preferably comprises a bimodal SNR estimation process which is also used on the training data to create valid look-up tables.

Still referring to FIG. 3, after each frame is filtered at filter bank (38) according to the filter selected therefor by estimator (36), a filtered decomposed speech signal (40) is transmitted to a reconstructor (42), where the filtered subbands are combined in order to construct an estimated clean speech signal (44). As previously discussed, however, reconstructor (42) may first determines an overall average error for a filtered speech signal comprising the filtered subbands. While any technique well known in the art may be used, such an overall average error is preferably calculated based on MSE.

Thereafter, reconstructor (42) may identify those filtered subband which, if excluded from the filtered speech signal, would reduce the overall average error. Such filtered subbands are then discarded, and reconstructor (42) combines the remaining filtered subbands in order to construct an estimated clean speech signal (44). As those of ordinary skill in the art will recognize, the system of the present invention also includes appropriate software for performing the above-described functions.

It should be noted that the subband filtering approach of the present invention is a generalization of the RASTA speech processing approach described above, as well as in U.S. Pat. No. 5,450,522 and an article by H. Hermansky et al. entitled "RASTA Processing of Speech", *IEEE Trans. Speech and Audio Proc.*, October, 1994. Moreover, while not adaptive, the foundation for the subband filtering concept using trained filterbanks is described in an article by H. Hermansky et al. entitled "Speech Enhancement Based on Temporal Processing", *IEEE ICASSP Conference Proceedings*, Detroit, Mich., 1995. Such references, of which the patent is assigned to the assignee of the present application, are hereby incorporated by reference.

In addition, the bias-variance trade-off concept is a related to the Signal Subspace Technique described in an article by Yariv Ephraim and Harry Van Trees entitled "A Signal Subspace Approach for Speech Enhancement," *IEEE ICASSP Proceedings*, 1993, vol. II), which is also hereby incorporated by reference. The bias-variance trade-off of the present invention, however, is a new way of characterizing this approach.

The present invention is thus a non-trivial adaptive hybrid and extension of RASTA and Signal Subspace techniques for noise suppression. In contrast to the present invention, such techniques are, respectively, not adaptive and have always been cast as a reduced rank model rather than a bias-variance trade-off problem.

As is readily apparent from the foregoing description, then, the present invention provides an improved method and system for filtering speech signals. More specifically, the present invention can be applied to speech signals to adaptively reduce noise in speaker to speaker conversation and in speaker to machine recognition applications. A better quality service will result in improved satisfaction among cellular and Personal Communication System (PCS) customers.

While the present invention has been described in conjunction with wireless communications, those of ordinary skill in the art will recognize its utility in any application where noise suppression is desired. In that regard, it is to be understood that the present invention has been described in an illustrative manner and the terminology which has been used is intended to be in the nature of words of description rather than of limitation. As previously stated, many modifications and variations of the present invention are possible in light of the above teachings. Therefore, it is also to be understood that, within the scope of the following claims, the invention may be practiced otherwise than as specifically described.

We claim:

1. A method for adaptively filtering a speech signal, the method comprising:

decomposing the speech signal into a plurality of subbands;

determining a speech quality indicator for each subband;

selecting one of a plurality of filters for each subband, wherein the filter selected depends on the speech quality indicator determined for the subband;

filtering each subband according to the filter selected;

determining an overall average error for a filtered speech signal comprising the filtered subbands;

identifying at least one filtered subband which, if excluded from the filtered speech signal, would reduce the overall average error determined; and combining, with the exception of the at least one filtered subband identified, the filtered subbands to provide an estimated filtered speech signal.

2. The method of claim 1 wherein decomposing the signal into subbands comprises performing a transform on the signal to provide approximately orthogonal components.

3. The method of claim 2 wherein performing a transform on the signal comprises performing a discrete Fourier transform on the signal.

4. The method of claim 1 wherein determining a speech quality indicator for each subband of the signal comprises estimating a signal to noise ratio for each subband of the signal.

5. The method of claim 1 wherein determining an overall average error for a filtered speech signal comprising the filtered subbands comprises calculating a mean-squared error.

6. The method of claim 1 further comprising estimating parameters for the plurality of filters based on a clean speech signal.

7. The method of claim 1 wherein the plurality of filters comprises a filter bank.

8. The method of claim 1 wherein each of the plurality of filters is associated with one of the plurality of subbands.

9. A system for adaptively filtering a speech signal, the system comprising:

means for decomposing the speech signal into a plurality of subbands;

means for determining a speech quality indicator for each subband;

a plurality of filters for filtering the subbands;

means for selecting one of the plurality of filters for each subband, wherein the filter selected depends on the speech quality indicator determined for the subband;

means for determining an overall average error for a filtered speech signal comprising the filtered subbands;

means for identifying at least one filtered subband which, if excluded from the filtered speech signal, would reduce the overall average error determined; and means for combining, with the exception of the at least one filtered subband identified, the filtered subbands to provide an estimated filtered speech signal.

10. The system of claim 9 wherein the means for decomposing the signal into subbands comprises means for performing a transform on the signal to provide approximately orthogonal components.

11. The system of claim 10 wherein the means for performing a transform on the signal comprises means for performing a discrete Fourier transform on the signal.

12. The system of claim 9 wherein the means for determining a speech quality indicator for each subband of the signal comprises means for estimating a signal to noise ratio for each subband of the signal.

13. The system of claim 9 wherein the means for determining an overall average error for a filtered speech signal comprising the filtered subbands comprises means for calculating a mean-squared error.

14. The system of claim 9 further comprising means for estimating parameters for the plurality of filters based on a clean speech signal.

15. The system of claim 9 wherein the plurality of filters comprises a filter bank.

16. The system of claim 9 wherein each of the plurality of filters is associated with one of the plurality of subbands.

* * * * *